US012220609B2

(12) United States Patent
Tank

(10) Patent No.: US 12,220,609 B2
(45) Date of Patent: Feb. 11, 2025

(54) KETTLEBELL

(71) Applicant: TOMMYBELL LLC, Calabasas, CA (US)

(72) Inventor: Thomas Tank, Calabasas, CA (US)

( * ) Notice: Subject to any disclaimer, the term of this patent is extended or adjusted under 35 U.S.C. 154(b) by 156 days.

(21) Appl. No.: 17/811,950

(22) Filed: Jul. 12, 2022

(65) Prior Publication Data

US 2023/0018677 A1 Jan. 19, 2023

Related U.S. Application Data

(63) Continuation of application No. 17/300,491, filed on Jul. 19, 2021, now abandoned.

(51) Int. Cl.
*A63B 21/075* (2006.01)
*A63B 21/00* (2006.01)

(52) U.S. Cl.
CPC ..... *A63B 21/075* (2013.01); *A63B 21/4035* (2015.10)

(58) Field of Classification Search
CPC ..... A63B 21/075; A63B 21/4035
See application file for complete search history.

(56) References Cited

U.S. PATENT DOCUMENTS

| | | | | |
|---|---|---|---|---|
| 5,637,064 | A * | 6/1997 | Olson | A63B 21/0728 482/107 |
| 9,802,073 | B2 * | 10/2017 | Pawlas | A63B 21/4035 |
| 10,933,272 | B2 * | 3/2021 | Polinsky | A63B 21/0626 |
| 2009/0062085 | A1 * | 3/2009 | Polevoy | A63B 21/0728 482/93 |
| 2013/0244843 | A1 * | 9/2013 | Burwell | A63B 21/0728 29/428 |
| 2022/0409945 | A1 * | 12/2022 | Bhandarkar | A63B 21/0726 |

* cited by examiner

*Primary Examiner* — Zachary T Moore
(74) *Attorney, Agent, or Firm* — Husch Blackwell LLP

(57) ABSTRACT

An improved kettlebell is provided. More specifically the improved kettlebell may include a frame with a holding portion and a base portion. The improved kettlebell may further include a weighted assembly including a first weighted component and a second weighted component. The weighted assembly may be coupled to the base portion of the frame through a fastener. Through the same fastener, the first weighted component may also be coupled with the second weighted component forming the weighted assembly. The weighted components may be manufactured to a variety of different weights, thus allowing users to adjust the weightlifting difficulty.

9 Claims, 7 Drawing Sheets

KETTLEBELL

CROSS REFERENCE TO RELATED APPLICATIONS

This application claims the benefit of the filing date of U.S. application Ser. No. 17/300,491 filed Jul. 19, 2021, entitled, "TOMMYBELL", which is hereby incorporated by reference as if fully set forth herein.

BRIEF SUMMARY OF THE INVENTION

This disclosure generally relates to an exercise device for weightlifting. More particularly, the disclosure relates to an improved kettlebell.

BACKGROUND OF THE INVENTION

Traditional kettlebells comprise of a spherical weighted body with a U-shaped frame. Kettlebells were originally formed and used over 300 years ago as a framed counterweight to weigh dry goods on balances. Since then, kettlebells have become a common individual fitness device due to their availability and simplicity. Users typically grip the kettlebell at the top of the U-shaped frame and then perform a variety of weightlifting exercises, such as bicep curls.

Because Kettlebells were not originally intended as a personal fitness device, there are numerous flaws that a user may experience when using them for weightlifting. Some of the flaws include abrasions to the hands and arms due to cast iron construction, injuries to the arms during rotation of the kettlebell during curling movements due to a short frame, and damage or injuries to any surface the kettlebell is dropped on due to the small bottom surface area of the sphere.

Additionally, due to the typical manufacturing methods of kettlebells, uneven internal weight distribution is common making some rotational exercise movements more difficult. Lastly, because the kettlebell frame is permanently affixed to the spherical weighted body, it is not possible for the user to adjust the weight of the kettlebell. Thus, there is a need for an improved kettlebell to address some or all of the above flaws.

Figure 1:
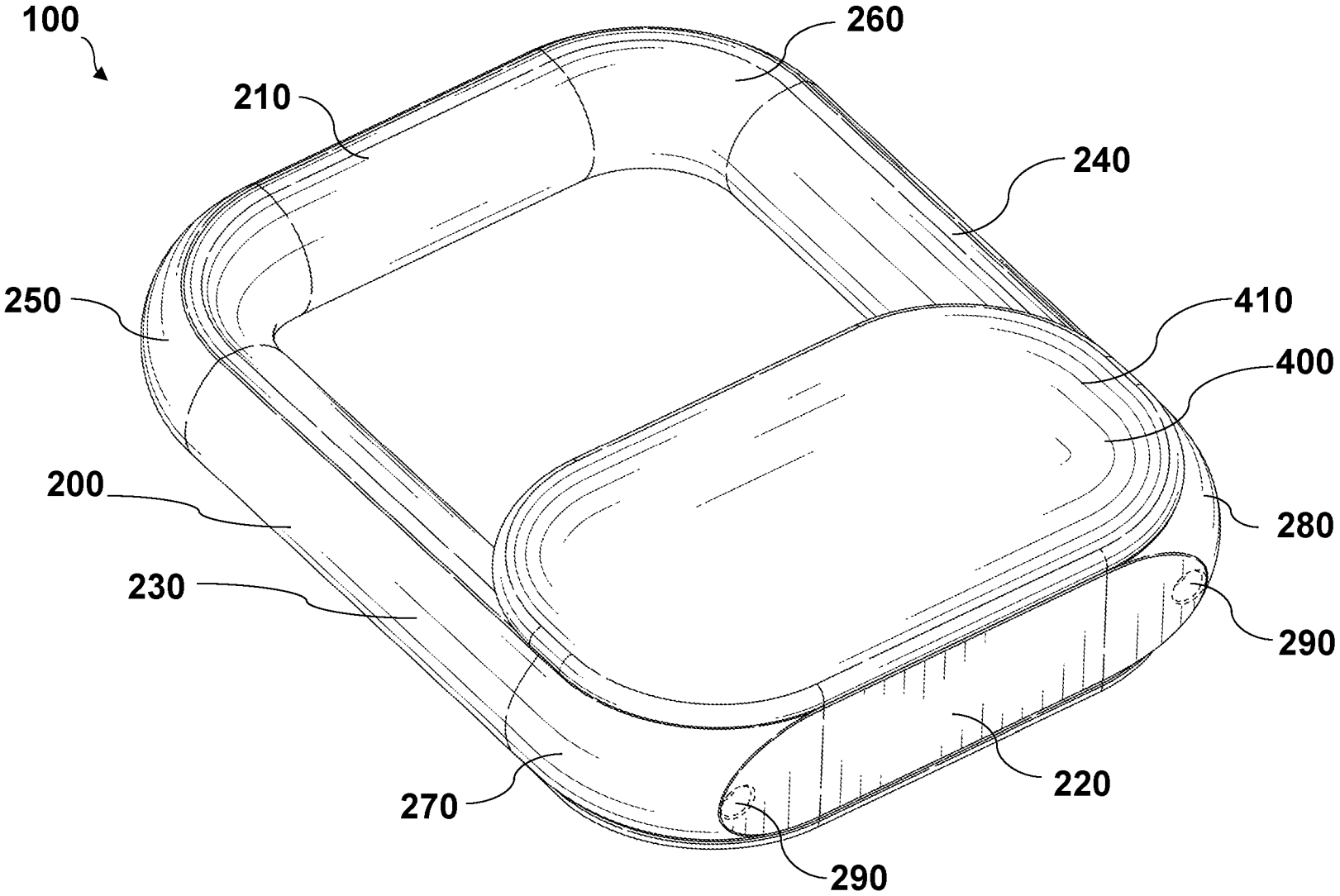
FIG. 1 illustrates a perspective view of an improved kettlebell assembly according to an example embodiment.

Before explaining the disclosed embodiment of the present invention in detail, it is to be understood that the invention is not limited in its application to the details of the particular arrangement shown, since the invention is capable of other embodiments. Example embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

While this invention is susceptible of embodiments in many different forms, there are shown in the drawings and will be described in detail herein specific embodiments with the understanding that the present disclosure is an exemplification of the principles of the invention. It is not intended to limit the invention to the specific illustrated embodiments. The features of the invention disclosed herein in the description, drawings, and claims may be significant, both individually and in any desired combinations, for the operation of the invention in its various embodiments. Features from one embodiment may be used in other embodiments of the invention.

Figure 2:
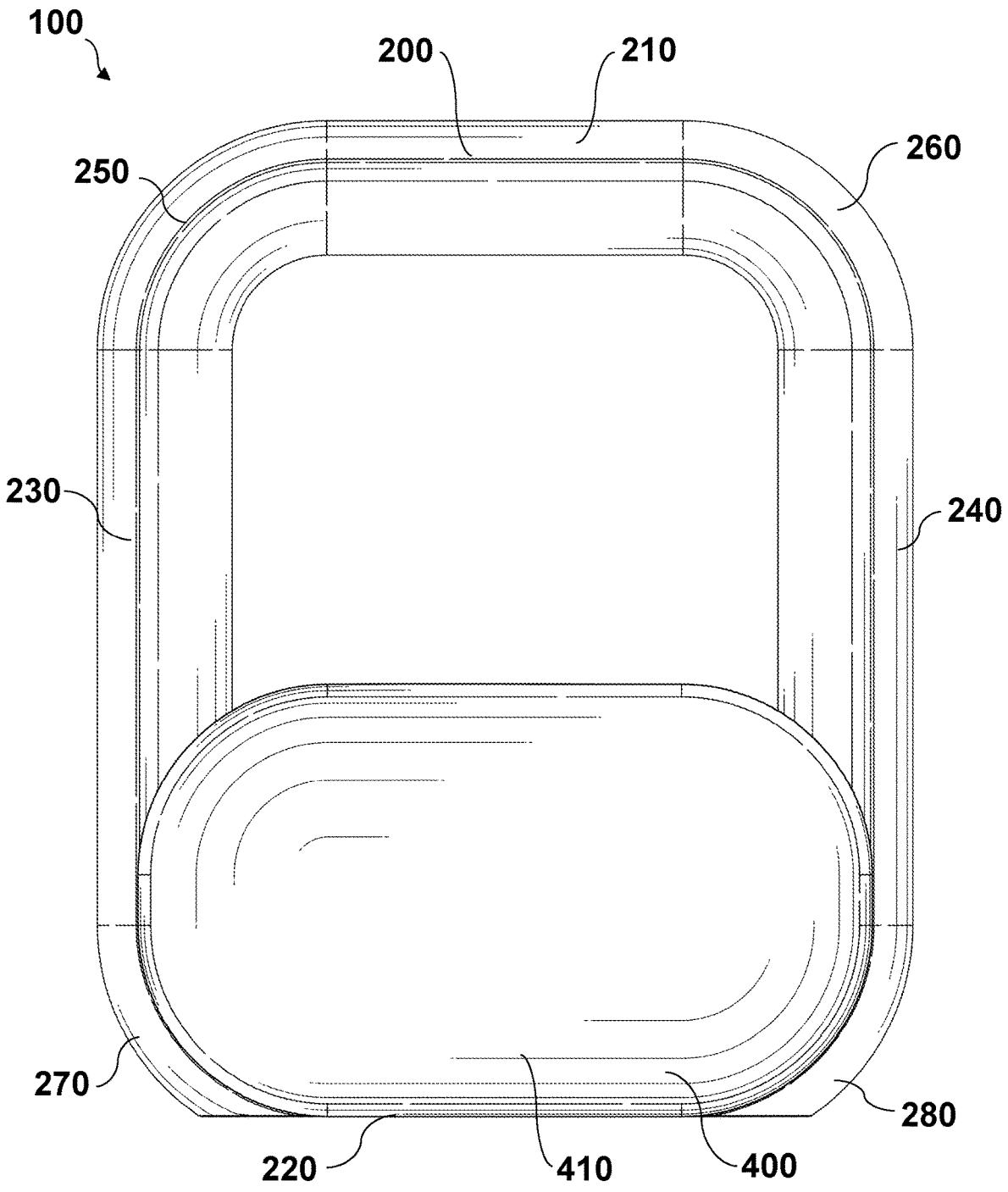
FIG. 2 illustrates a front view of the improved kettlebell assembly of FIG. 1.
Figure 3:
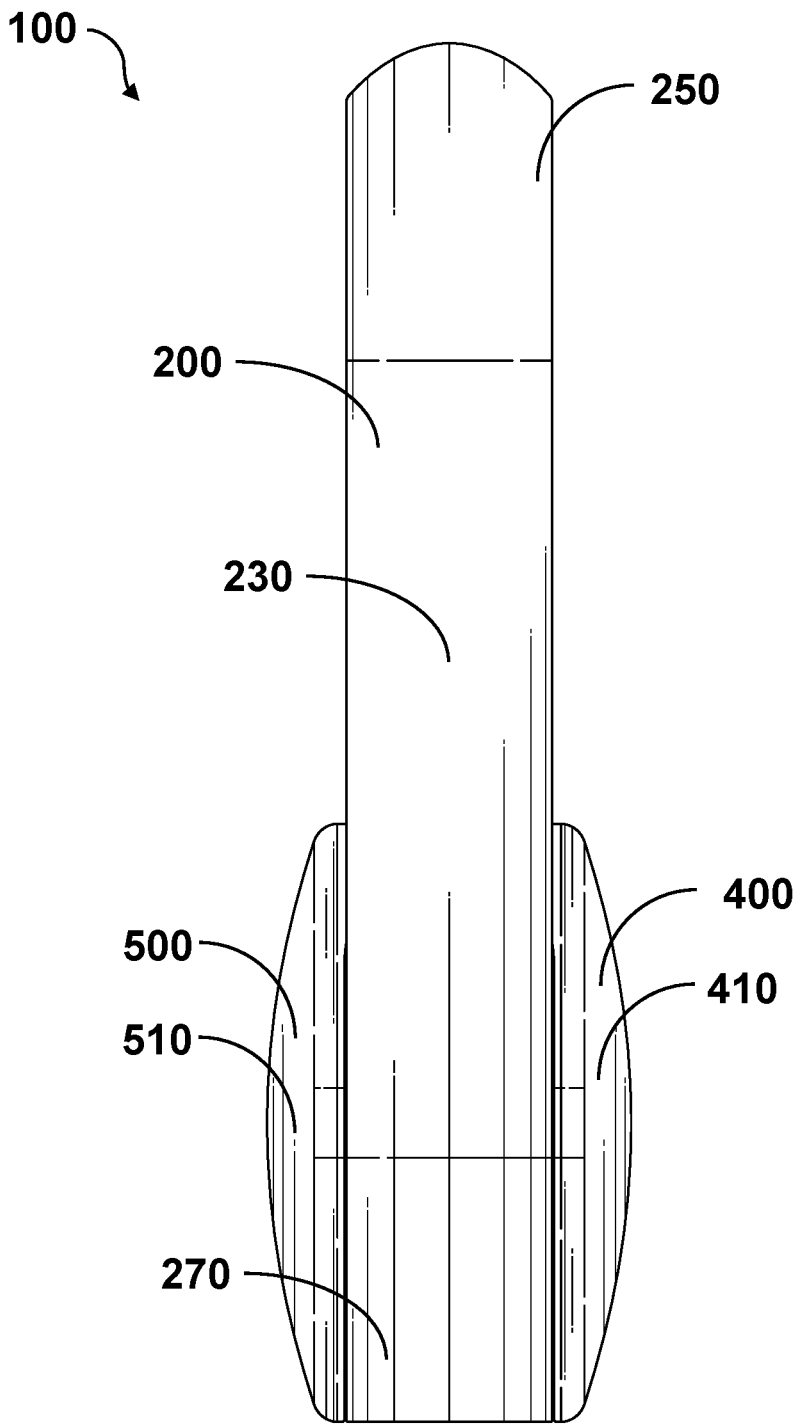
FIG. 3 illustrates a side view of the improved kettlebell assembly of FIG. 1.
Figure 4:
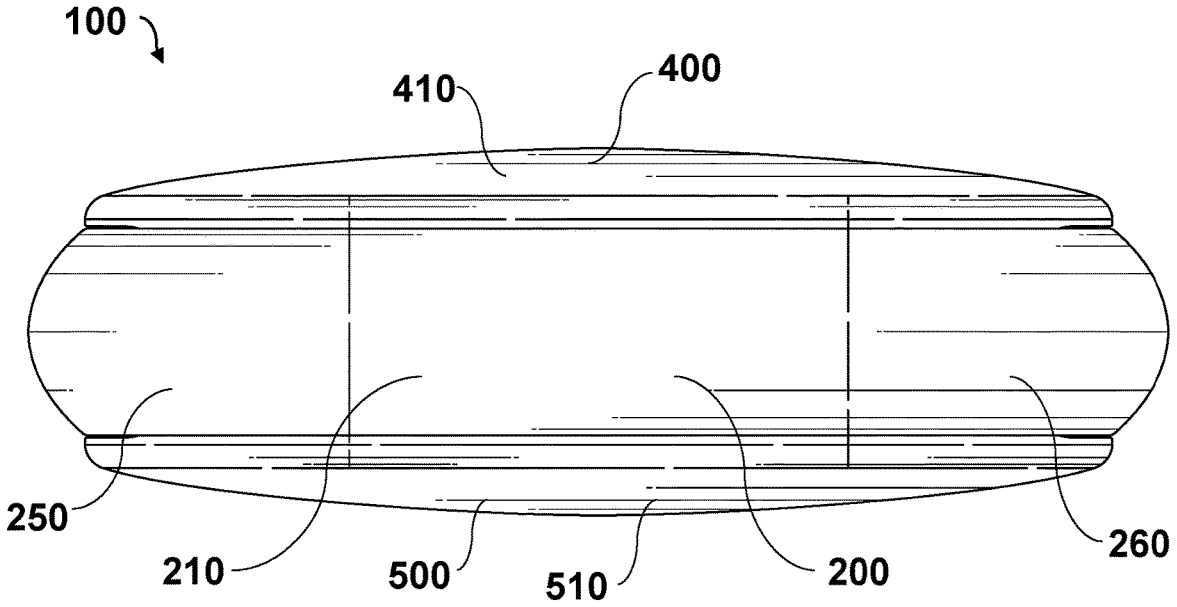
FIG. 4 illustrates a top view of the improved kettlebell assembly of FIG. 1.
Figure 5:
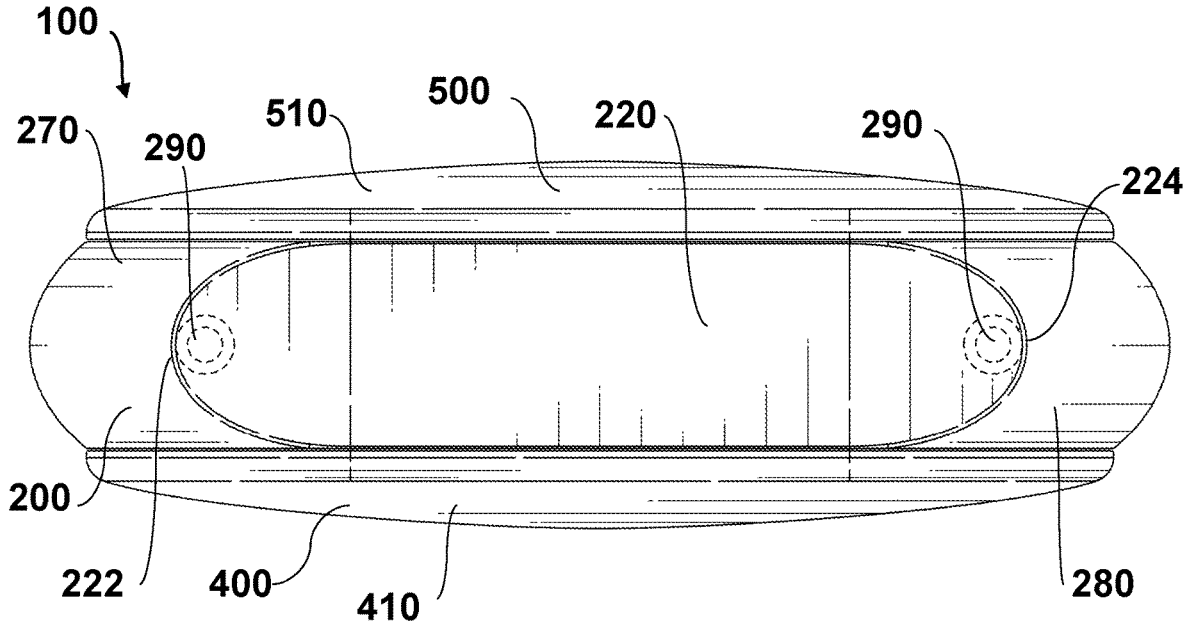
FIG. 5 illustrates a bottom view of the improved kettlebell assembly of FIG. 1.
Figure 6:
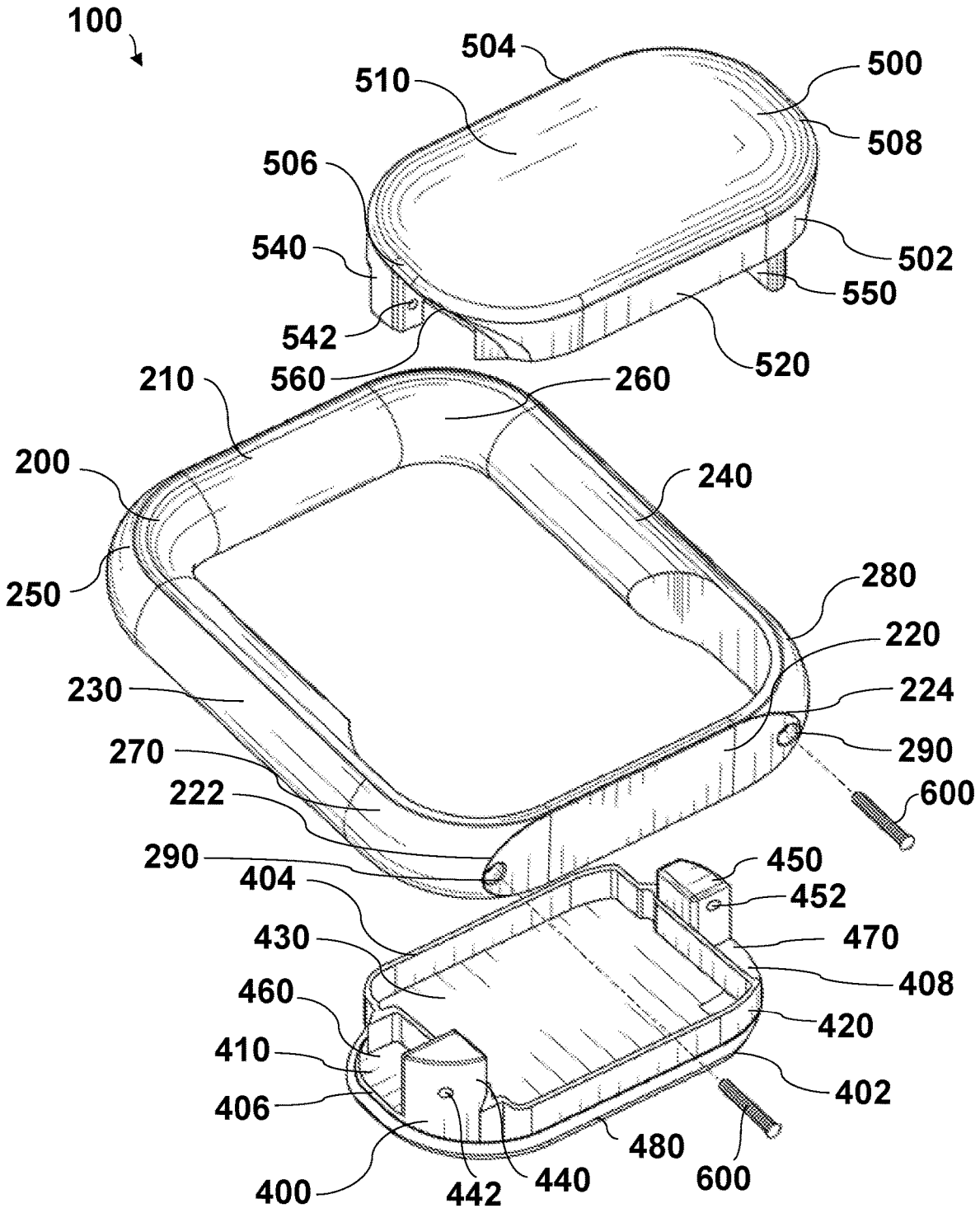
FIG. 6 illustrates an exploded view of the improved kettlebell assembly according to an example embodiment.

As shown in FIGS. 1-8, the embodiments of this disclosure include an improved kettlebell assembly 100. In particular, FIG. 1 illustrates a perspective view of the kettlebell assembly 100 according to an example embodiment. FIG. 2 illustrates a front view of the kettlebell assembly 100 according to the example embodiment. FIG. 3 illustrates a side view of the kettlebell assembly 100 according to the example embodiment. FIG. 4 illustrates a top view of the kettlebell assembly 100 according to the example embodiment. FIG. 5 illustrates a bottom view of the kettlebell assembly 100 according to the example embodiment. FIG. 6 illustrates an exploded view of the kettlebell assembly 100 according to the example embodiment.

Referring to FIGS. 1-8, the improved kettlebell assembly 100 may include a frame 200 and a weighted assembly 300.

Figure 7:
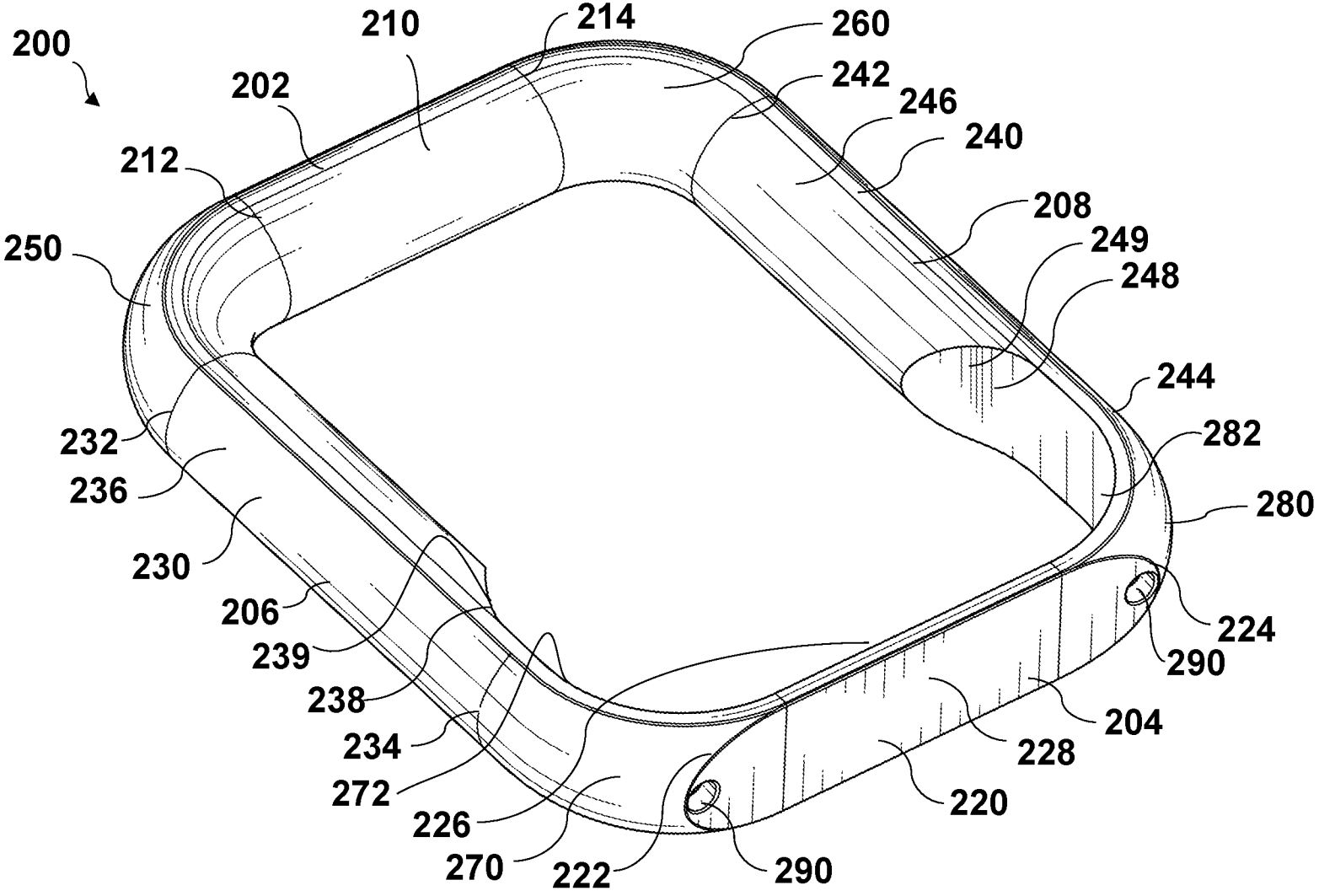
FIG. 7 illustrates a perspective view of a frame of the improved kettlebell assembly according to an example embodiment.

As best shown in FIG. 7, according to an example embodiment, the frame 200 may be the shape of a loop. In some embodiments, the frame 200 may be a rectangular loop. The frame 200 may include a holding portion 210 on a first side 202 of the frame 200, a base portion 220 on a second side 204 opposite from and parallel to the first side 202, a first connecting portion 230 on a third side 206 perpendicular with respect to the first side 202 and second side 204, and a second connecting portion 240 on a fourth side 208 opposite from and parallel to the third side 206.

The holding portion 210 may be cylindrical in shape having a first circumference, and adapted to be held by a user of the improved kettlebell assembly 100. The holding portion 210 may be flanked by a first corner portion 250 on a first end 212 and a second corner portion 260 on a second end 214 opposite from the first end 212. The first corner portion 210 and the second corner portion 260 may be cylindrical in shape with a 90 degree bend away from the holding portion 210 such that the respective distal ends of the first corner portion 250 and the second corner portion 260 are perpendicular with respect to the holding portion 210. The first corner portion 250 and the second corner portion 260 may have the first circumference with the holding portion 210 at the respective proximal end of the first corner portion 250 and the second corner portion 260 with respect to the holding portion 210. Likewise, the respective distal end of the first corner portion 250 and the second corner portion 260 with respect to the holding portion 210 may also have the same the first circumference after their respective 90-degree bend.

The first connecting portion 230 may be flanked by the first corner portion 250 on a first end 232 and a third corner portion 270 on a second end 234. Likewise, the second connecting portion 240 may be flanked by the second corner portion 260 on a first end 242 and a fourth corner portion 280 on a second end 244.

From their respective first ends 232, 242 the first connecting portion 230 and the second connecting portion 240 may each begin as cylindrical in shape having the first circumference. As the first connecting portion 230 and the second connecting portion 240 transition toward their respective second ends 234 and 244, the cylindrical shape may taper into a half-cylindrical shape as it reaches the respective second end 234 and 244. Put differently, in some embodiments, the first connecting portion 230 and the second connecting portion 240 may each have a cylindrical portion 236, 246, and may also each have a taper portion 238 and 248 respectively that tapers from a cylinder shape into a half-cylinder shape.

The base portion 220 may be flanked by the third corner portion 270 on a first end 222 and the fourth corner portion 280 on a second end 224. In some embodiments, the base portion 220 may be substantially flat and rectangular.

The third corner portion 270 and the fourth corner portion 280 may each be half-cylindrical in shape at their respective ends proximal to the first connecting portion 230 and the second connecting portion 240. More precisely, in some embodiments, the third corner portion 270 and the fourth corner portion 280 may each begin with a flat inner surface and a curved outer surface at ends 234 and 244 proximal to the first connecting portion 230 and the second connecting portion 240, respectively. The third corner portion 270 and the fourth corner portion 280 may each have a 90 degree bend and connect with the base portion 220 at ends 222 and 224.

The third corner portion 270 and the fourth corner portion 280 may each have an inner surface 272, 282. The base portion may also have an inner surface 226 and an outer surface 228 opposite from the inner surface 226. Together with inner surfaces 239, 249 of the taper portions 238, 248, the inner surfaces 272, 282, 226 may form a profile adapted to receive the weighted assembly 300. The outer surface 228 of the base portion 220 may be substantially flat and adapted to be in regular contact with an external surface such as a floor of a gym. One or more fastening holes 290 may be provided at the base portion 220 to receive one or more fasteners 600 (see FIG. 6) so that the weighted assembly 300 may be fastened to the frame 200. In some embodiments, the fastening hole 290 may have a threaded interior. In other embodiments, the fastening hole 290 may have a smooth or substantially smooth interior. In an example embodiment, a fastening hole 290 may be provided proximal to each end 222, 224 of the base portion 220. In other embodiments, the fastening hole 290 may be provided on one or more of the corner portions 250, 260, 270, 280, or one or more of the connecting portions 230, 240 in addition to or instead of being provided on the base portion 220.

In an example embodiment, the frame 200 may be coupled to and decoupled from a plurality of weighted assemblies 300 of different weights so that the user may adjust the weight of the improved kettlebell assembly 100 based on the desired weight. The frame 200 may be formed as one unitary piece. Alternatively, each or some portions of the frame 200 may be formed as separate pieces.

Figure 8:
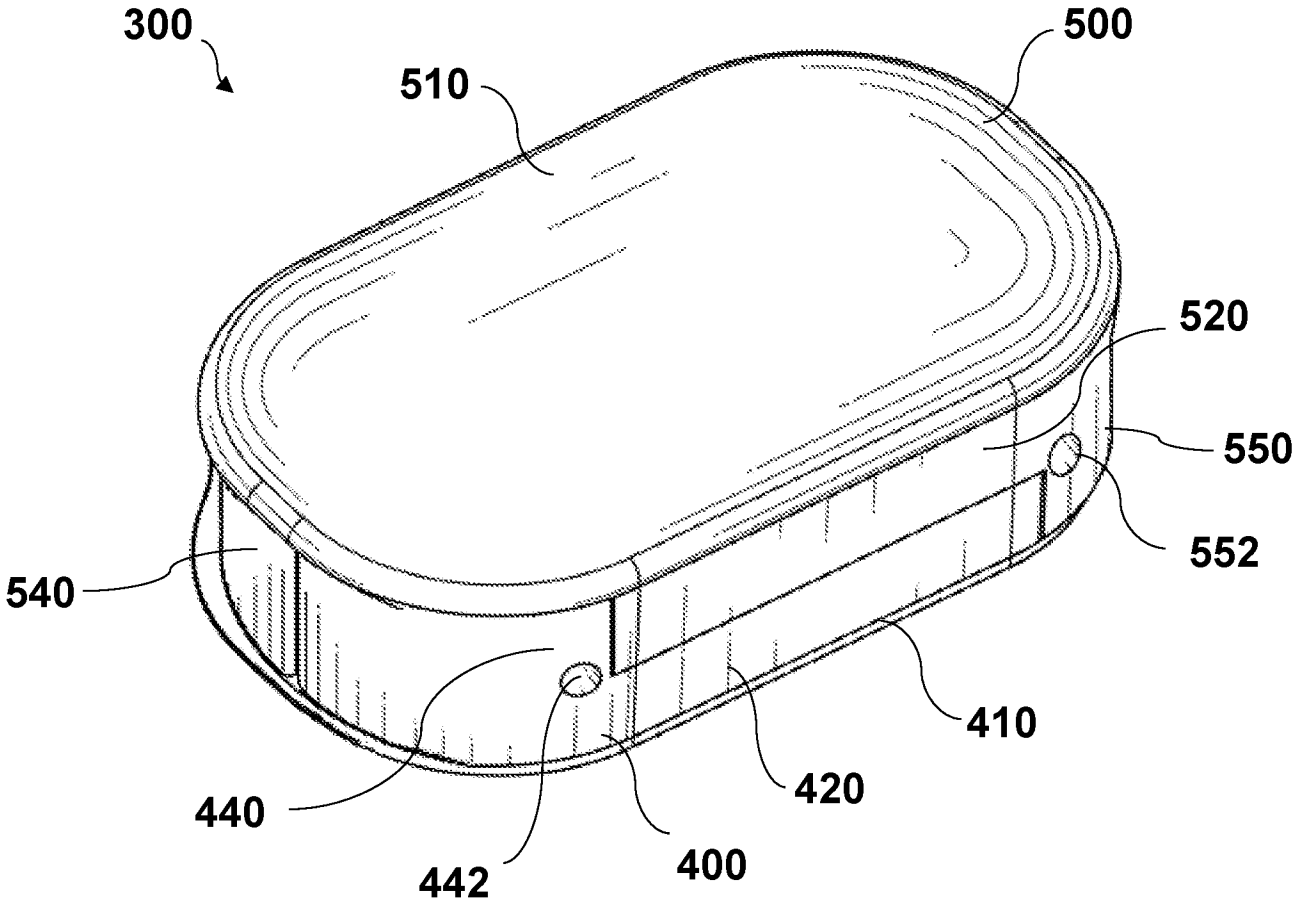
FIG. 8 illustrates a perspective view of a weight assembly of the improved kettlebell assembly according to an example embodiment.

Referring to FIGS. 6 and 8, the weighted assembly 300 may include a first weighted component 400 and a second weighted component 500.

The first weighted component 400 may include a first shell portion 410 and a first body portion 420 extending from the first shell portion 410 such that the first body portion 420 is generally perpendicular to the first shell portion 410. In some embodiments, the first shell portion 410 may have a profile of a rectangle with rounded corners such that a profile of the first shell portion 410 generally matches a profile of the frame 200 or one or more portions of the frame 200.

Within the first body portion 420 may be a first chamber 430. The first chamber 430 may be hollow, partially hollow, or solid. In some embodiments, by adjusting the hollowness of the first chamber 430, the first weighted component 400 may be lighter or heavier. For example, in an embodiment where the mass of the weighted assembly 300 is 6 kilogram (kg), the first chamber 430 may be mostly hollow. In another example where the mass of the weighted assembly 300 is 20 kg, the first chamber 430 may be mostly solid. Likewise, by adjusting the size of the first body portion 420, the overall weight of the first weighted component 400, and thus the overall weight of the weighted assembly 300 as a whole may vary as well. For example, if the first body portion 420 is thicker, the overall weight of the weighted assembly 300 may be heavier, and vice versa.

The first weighted component 400 may also include one or more engagement protrusions to engage the second weighted component 500. In the example embodiment shown in FIG. 6, the first weighted component 400 may include a first engagement protrusion 440 and a second engagement protrusions 450, each extending beyond the first body portion 420. The first engagement protrusion 440 and the second engagement protrusion 450 may be provided on opposite sides of the first weighted component 400. Further, the first engagement protrusion 440 and the second engagement protrusion 450 may be biased off a common axis from each other.

In the example embodiment shown in FIG. 6, the first weighted component 400 may have a first side 402, a second side 404 opposite from and parallel to the first side 402, a third side 406 that is perpendicular to the first side 402 and the second side 404, and a fourth side 408 opposite from and parallel to the third side 406.

In an example embodiment, the first engagement protrusion 440 may be provided proximal to the first side 402 and the third side 406, while the second engagement protrusion 450 may be provided proximal to the second side 404 and the fourth side 408. Because the first engagement protrusion 440 is proximal to the first side 402 and the second engagement protrusion 450 is proximal to the second side 404 opposite from the first side 402, the two engagement protrusions 440, 450 are thus biased from one another. In other embodiments, both the first engagement protrusion 440 and the second engagement protrusion 450 may be proximal to the first side 402, or both be proximal to the second side 404, thus not biased. Certainly, embodiments including more or less engagement protrusions are also contemplated together with a variety of configurations and positions.

The first engagement protrusion 440 and the second engagement protrusion 450 may each include a bore 442, 452 for receiving a fastener 600. Similar to the fastening holes 290 of the frame, the bores 442, 452 may be threaded or unthreaded. In some embodiments, the bore on the forward biased engagement protrusion (i.e., the bore 442 of the first engagement protrusion 440 in the example embodiment shown in FIG. 6) may extend through the entire engagement protrusion, allowing the fastener 600 to pass through the engagement protrusion through the bore. Whereas the bore on the rearward biased engagement protrusion (i.e., the bore 452 of the second engagement protrusion 450 in the example embodiment shown in FIG. 6) may extend just partially through the engagement protrusion.

The first weighted component 400 may further include a first engagement cavity 460, defined partially by the first shell portion 410, the first body portion 420, and the first engagement protrusion 440, and a second engagement cavity 470, defined partially by the first shell portion 410, the first body portion 420, and the second engagement protrusion 450.

Moreover, the first body portion 420 may be setback on the first side 402 with respect to the first shell portion 410, defining a ledge 480 together with the first shell portion 410. A width of the ledge 480 may be the same or substantially similar to a thickness of the base portion 220 of the frame 200, creating a substantially flush bottom surface for the improved kettlebell assembly 100 as a whole when the weighted assembly 300 is assembled onto the frame 200.

Structurally, the second weighted component 500 may be substantially similar to the first weighted component 400, with the exception that the forward/rearward bias of a first engagement protrusion 540 and a second engagement protrusion 550 of the second weighted component 500 would be flipped from the first engagement protrusion 440 and the second engagement protrusion 450 of the first weighted component 400, allowing the first weighted component 400 to be joined with the second weighted component 500, forming the weighted assembly 300.

Similar to the first weighted component 400, the second weighted component 500 may include a second shell portion 510 and a second body portion 520 extending from the second shell portion 510 such that the second body portion 520 is generally perpendicular to the second shell portion 510. In some embodiments, the second shell portion 510 may have a profile of a rectangle with rounded corners such that the profile of the second shell portion 510 generally matches a profile of the frame 200 or one or more portions of the frame 200.

Within the second body portion 520 may be a second chamber (not shown). The second chamber may be hollow, partially hollow, or solid. In some embodiments, by adjusting the hollowness of the second chamber, the second weighted component 500 may be lighter or heavier. For example, in an embodiment where the weighted assembly 300 is 6 kg, the second chamber may be mostly hollow. In another example where the weighted assembly 300 is 20 kg, the second chamber may be mostly solid. Likewise, by adjusting the size of the second body portion 520, the overall weight of the second weighted component 500, and thus the overall weight of the weighted assembly 300 as a whole may vary as well. For example, if the second body portion 520 is thicker, the overall weight of the weighted assembly 300 may be heavier, and vice versa.

The second weighted component 500 may also include one or more engagement protrusions to engage the first weighted component 400. In the example embodiment shown in FIG. 6, the second weighted component 500 may include the first engagement protrusion 540 and the second engagement protrusions 550, each extending beyond the second body portion 520. The first engagement protrusion 540 and the second engagement protrusion 550 may be provided on opposite sides of the second weighted component 500. Further, the first engagement protrusion 540 and the second engagement protrusion 550 may be biased off a common axis from each other.

In the example embodiment shown in FIG. 6, the second weighted component 500 may have a first side 502, a second side 504 opposite from and parallel to the first side 502, a third side 506 that is perpendicular to the first side 502 and the second side 504, and a fourth side 508 opposite from and parallel to the third side 506.

In an example embodiment, the first engagement protrusion 540 may be provided proximal to the second side 504 and the third side 506, while the second engagement protrusion 550 may be provided proximal to the first side 502 and the fourth side 508. Because the first engagement protrusion 540 is proximal to the second side 504 opposite from the first side 502 and the second engagement protrusion 550 is proximal to the first side 502, the two engagement protrusions 540, 550 are thus biased from one another. In other embodiments, both the first engagement protrusion 540 and the second engagement protrusion 550 may be proximal to the first side 502, or both be proximal to the second side 504, thus not biased. Certainly, embodiments including more or less engagement protrusions are also contemplated together with a variety of configurations and positions.

The first engagement protrusion 540 and the second engagement protrusion 550 may each include a bore 542, 552 for receiving a fastener 600. Similar to the fastening holes 290 of the frame, the bores 542 may be threaded or unthreaded. In some embodiments, the bore on the forward biased engagement protrusion (i.e., the bore 552 of the second engagement protrusion 550 in the example embodiment shown in FIG. 6) may extend through the entire engagement protrusion, allowing the fastener 600 to pass through the engagement protrusion through the bore. Whereas the bore on the rearward biased engagement protrusion (i.e., the bore 542 of the first engagement protrusion 540 in the example embodiment shown in FIG. 6) may extend just partially through the engagement protrusion.

The second weighted component 500 may further include a first engagement cavity 560, defined partially by the second shell portion 510, the second body portion 520, and the first engagement protrusion 540, and a second engagement cavity (not shown), defined partially by the second shell portion 510, the second body portion 520, and the second engagement protrusion 550.

Moreover, the second body portion 520 may be setback on the first side 502 with respect to the second shell portion 510, defining a ledge together with the second shell portion 510. A width of the ledge 580 may be the same or substantially similar to a thickness of the base portion 220 of the frame 200, creating a substantially flush bottom surface for the improved kettlebell assembly 100 as a whole when the weighted assembly 300 is assembled onto the frame 200.

When the weighted assembly 300 is assembled, the first engagement protrusion 440 of the first weighted component 400 may be fitted into the first engagement cavity 560 of the second weighted component 500 and the second engagement protrusion 450 of the first weighted component 400 may be fitted into the second engagement cavity of the second weight component 500. Conversely, when the weighted assembly 300 is assembled, the first engagement protrusion 540 of the second weighted component 500 may be fitted into the first engagement cavity 460 of the first weighted component 400 and the second engagement protrusion 550 of the second weighted component 500 may be fitted into the second engagement cavity 470 of the first weight component 400.

As illustrated in FIG. 6, when the improved kettlebell assembly 100 is assembled, fasteners 600 may be inserted through their respective fastening holes 290 of the frame 200. Therefrom, the fastener 600 proximal to end 222 may extend through bore 442 of the first engagement protrusion 440 of the first weighted component 400 into bore 542 of the first engagement protrusion 540 of the second weighted component 500. Likewise, the fastener 600 proximal to end 224 may extend through bore 552 of the second engagement protrusion 550 of the second weighted component 500 into bore 452 of the second engagement protrusion 450 of the first weighted component 400.

In some embodiments, the frame 200 may be manufactured from 304 stainless steel or a similar metal alloy. In some embodiments, the first weighted component 400 and the second weighted component 500 may also be manufactured from 304 stainless steel or a similar metal alloy.

As explained above, the weighted assembly 300 may be coupled to the frame 200 using one or more fasteners 600. In an example embodiment, the fasteners 600 may be machine screws; however, in other embodiments, other types of fasteners such as wood screws, bolts, pins, rivets, or the like may also be used.

In some embodiments, one or more sensors may be coupled to the improved kettlebell assembly 100. For example, a sensor may be provided on a surface of the weighted assembly 300 or inside the weighted assembly 300 (such as within the first chamber 430 and/or the second chamber). Alternatively or additionally, the sensor may be provided on the frame 200. The sensor may be configured to communicate with an external device such as a mobile phone, a personal computer (PC), a laptop, another fitness device, or the like. Communication between the sensor and the external device may take place through hardwire (such as USB or Lighting), or through a wireless communication protocol (such as WiFi or Bluetooth).

Specific embodiments of an improved kettlebell assembly according to the present invention have been described for the purpose of illustrating the manner in which the invention may be made and used. It should be understood that the implementation of other variations and modifications of this invention and its different aspects will be apparent to one skilled in the art, and that this invention is not limited by the specific embodiments described. Features described in one embodiment may be implemented in other embodiments. The subject disclosure is understood to encompass the present invention and any and all modifications, variations, or equivalents that fall within the spirit and scope of the basic underlying principles disclosed and claimed herein.

What is claimed is:

1. A fitness device comprising:

a frame including a holding portion adapted to be held by a user on a first side and a base portion on a second side opposite from the first side; and a weighted assembly selectively coupled to the base portion, wherein the weighted assembly comprises a first weighted component selectively coupled to a second weighted component, wherein the first weighted component comprises a first shell portion, a first body portion extending from the first shell portion, and a first engagement protrusion extending beyond the first body portion and a first engagement cavity, wherein the second weighted component comprises a second shell portion, a second body portion extending from the second shell portion, and a second engagement protrusion extending beyond the second body portion and a second engagement cavity, wherein the first body portion abuts the second body portion when the weighted assembly is assembled, wherein the first engagement protrusion is received in the second engagement cavity and the second engagement protrusion is received in the first engagement cavity when the weighted assembly is assembled, wherein the weighted assembly is coupled to the frame through a fastener, and wherein the fastener extends through the base portion of the frame, the first bore of the first weighted component, and partially through the second bore of the second weighted component.

2. The device of claim 1, wherein the frame is formed as one unitary piece in a shape of a closed loop.

3. The device of claim 1, wherein the frame and the weighted assembly are both made of stainless steel.

4. A fitness device comprising:

a frame including a holding portion adapted to be held by a user on a first side and a base portion on a second side opposite from the first side; and a weighted assembly selectively coupled to the base portion, wherein the weighted assembly comprises a first weighted component selectively coupled to a second weighted component, wherein the first weighted component comprises a first shell portion, a first body portion extending from the first shell portion, and a first engagement protrusion extending beyond the first body portion and a first engagement cavity, wherein the second weighted component comprises a second shell portion, a second body portion extending from the second shell portion, and a second engagement protrusion extending beyond the second body portion and a second engagement cavity, wherein the first body portion abuts the second body portion when the weighted assembly is assembled, wherein the first engagement protrusion is received in the second engagement cavity and the second engagement protrusion is received in the first engagement cavity when the weighted assembly is assembled, wherein the first weighted component further comprises a third engagement protrusion extending beyond the first body portion and a third engagement cavity;

the second weighted component further comprising a fourth engagement protrusion extending beyond the second body portion and a fourth engagement cavity, wherein the third engagement protrusion is received in the fourth engagement cavity and the fourth engagement protrusion is received in the third engagement cavity when the weighted assembly is assembled.

5. The device of claim 4, the first engagement protrusion further comprising a first bore, the second engagement protrusion further comprising a second bore, the third engagement protrusion further comprising a third bore, and the fourth engagement protrusion further comprising a fourth bore, wherein the first bore and the second bore are aligned when the weighted assembly is assembled, and wherein the third bore and the fourth bore are aligned when the weighted assembly is assembled.

6. The device of claim 5, wherein the weighted assembly is coupled to the frame through a first fastener and a second fastener, wherein the first fastener extends through a first fastener hole of the base portion of the frame, the first bore of the first weighted component, and partially through the second bore of the second weighted component, and wherein the second fastener extends through a second fastener hole of the base portion of the frame, the fourth bore of the second weighted component, and partially through the third bore of the first weighted component.

7. The device of claim 6, wherein the weighted assembly may be removed from the frame through removing the first fastener and the second fastener.

8. The device of claim 4, wherein the weighted assembly includes a first side, a second side opposite from the first side, a third side perpendicular to the first side, and a fourth side opposite from the third side, wherein the first engagement protrusion and the second engagement protrusion are positioned proximal to the third side, and the third engagement protrusion and the fourth engagement protrusion are positioned proximal to the fourth side.

9. The device of claim 8, wherein the first engagement protrusion and the fourth engagement protrusion are positioned proximal to the first side, and the second engagement protrusion and the third engagement protrusion are positioned proximal to the second side.

* * * * *